US006550697B2

(12) United States Patent
Lai

(10) Patent No.: US 6,550,697 B2
(45) Date of Patent: Apr. 22, 2003

(54) SHOWER HEAD ASSEMBLY

(75) Inventor: Johnson Lai, Taichung Export Processing Zone (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 1 day.

(21) Appl. No.: 09/940,838

(22) Filed: Aug. 28, 2001

(65) Prior Publication Data

US 2003/0042332 A1 Mar. 6, 2003

(51) Int. Cl.[7] ..... A62C 31/00

(52) U.S. Cl. ..... 239/446; 239/436; 239/443; 239/444; 239/447; 137/876; 137/801

(58) Field of Search ..... 239/436, 438, 239/440, 443, 444, 551, DIG. 1, 553.5, 558, 562, 581.1, 581.2, 582.1; 137/876, 887, 625.41, 801; 251/208

(56) References Cited

U.S. PATENT DOCUMENTS 3,625,255 A * 12/1971 Genin ..... 137/637.3
4,117,979 A * 10/1978 Lagarelli et al. ..... 239/381
4,131,233 A * 12/1978 Koenig ..... 239/381
4,254,914 A * 3/1981 Shames et al. ..... 239/383
4,497,444 A * 2/1985 Arnold ..... 239/472
4,669,666 A * 6/1987 Finkbeiner ..... 239/438
5,860,599 A * 1/1999 Lin ..... 239/443
5,918,811 A * 7/1999 Denham et al. ..... 239/123
6,032,877 A * 3/2000 Kagan ..... 239/446
6,126,091 A * 10/2000 Heitzman ..... 239/380
6,227,246 B1 * 5/2001 Hall et al. ..... 137/625.41
6,378,790 B1 * 4/2002 Paterson et al. ..... 239/458

* cited by examiner

*Primary Examiner*—Michael Mar
*Assistant Examiner*—Darren Gorman

(57) ABSTRACT

A shower head assembly includes a shower base mounted on a lower end of a housing body to confine central and surrounding conduits, a valve member disposed to be turned to control water flow from a main inlet of the housing body to flow into one of the central and surrounding conduits, and an elongated operating member which has an inner connecting end secured to the valve member, and an outer operating end extending outwardly of the housing body so as to be operated externally to turn the valve member.

9 Claims, 11 Drawing Sheets

SHOWER HEAD ASSEMBLY

BACKGROUND OF THE INVENTION

1. Field of the Invention

This invention relates to a shower head assembly, more particularly to a shower head assembly with an operating member extending outwardly of a shower head body for external operation so as to control discharging areas of water flow from the shower head body.

2. Description of the Related Art

A conventional shower head body generally includes a shower base which is mounted on a lower end of a housing body. The shower base has a wall which includes central and surrounding portions provided with a plurality of central and surrounding outlets for outward spraying of water. A valve member is disposed in the shower base and is shifted such that water is discharged from one or both of the central and surrounding outlets. An operating member is disposed on the wall and is operated to shift the valve member. However, during operation when water spraying, the user's hand is in direct contact with water, which results in water splashing, thereby causing inconvenience to the user.

SUMMARY OF THE INVENTION

The object of the present invention is to provide a shower head assembly which facilitates operation of a valve member to permit water to spray out from different areas.

According to this invention, the shower head assembly includes a housing body, a shower base, a valve member and an elongated operating member. The housing body has upper and lower ends opposite to each other in a longitudinal direction, and an inner annular wall which is interposed between the upper and lower ends, and which extends along a rotating axis to terminate at an inner end surface so as to confine a chamber. The inner end surface is provided with first and second inlet ports communicated with the chamber. A main inlet is formed in the inner annular wall to communicate with the chamber, and extends radially relative to the rotating axis and toward the upper end to communicate with a water supply channel. The shower base includes an upper wall which is anchored to the lower end, and a lower wall opposite to the upper wall in the longitudinal direction. The lower wall includes a central portion, and a surrounding portion which surrounds the central portion. The central and surrounding portions respectively have central and surrounding outlet ports for outward spraying of water. First and second through-flow ducts are formed in and through the housing body. The first and second through-flow ducts have first and second proximate ends which are disposed between the upper and lower ends, and which are connected to and which are communicated with the first and second inlet ports respectively, and first and second distal ends which extend into and through the upper wall so as to communicate with the central and surrounding outlet ports, respectively. The valve member is received in the chamber, and has an annular surrounding wall and a valve end surface which are rotatable relative to the inner annular wall and the inner end surface respectively about the rotating axis. The valve member further has a communicating duct which has an inflow port that is formed in and that extends along the annular surrounding wall and that is communicated with the main inlet when the annular surrounding wall is rotated relative to the inner annular wall. The communicating duct further has an outflow port which extends through the valve end surface in an axial direction parallel to the rotating axis.

When the valve member is turned about the rotating axis to a first position, the outflow port is registered with the first inlet port to communicate the communicating duct with the first through-flow duct so as to permit water to be discharged from the central outlet port. When the valve member is turned to a second position, the outflow port is registered with the second inlet port to communicate the communicating duct with the second through-flow duct so as to permit water to be discharged from the surrounding outlet port. The operating member has an inner connecting end which is secured on the valve member, and an outer operating end which extends outwardly from the inner connecting end in the axial direction and outwardly of the housing body so as to be operated externally to turn the valve member between the first and second positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
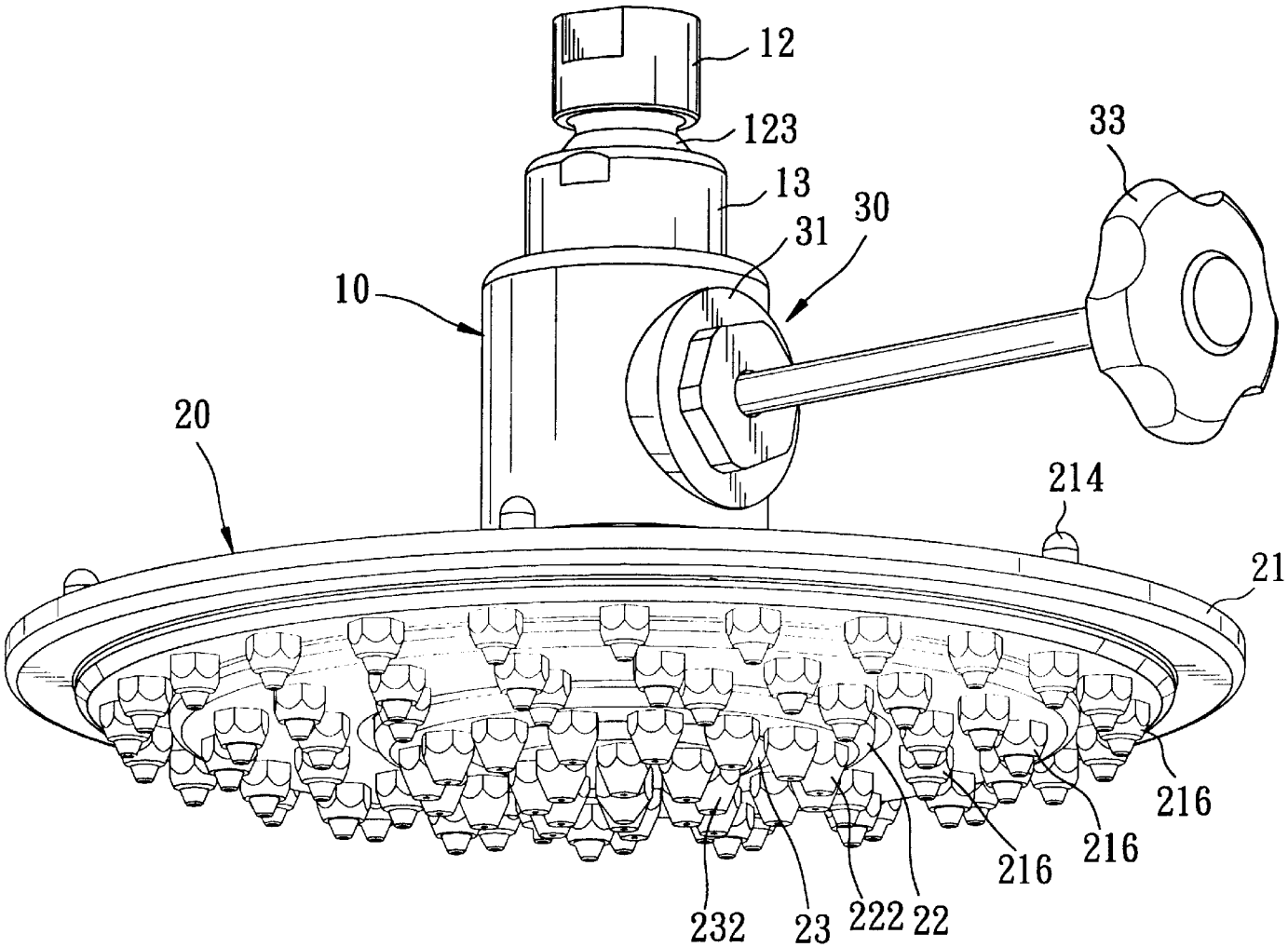
FIG. 1 is a perspective view of a preferred embodiment of a shower head assembly according to this invention.

Referring to FIG. 1, the preferred embodiment of the shower head assembly according to the present invention is shown to comprise a housing body 10, a shower base 20, and a valve and operating mechanism 30.

Figure 2:
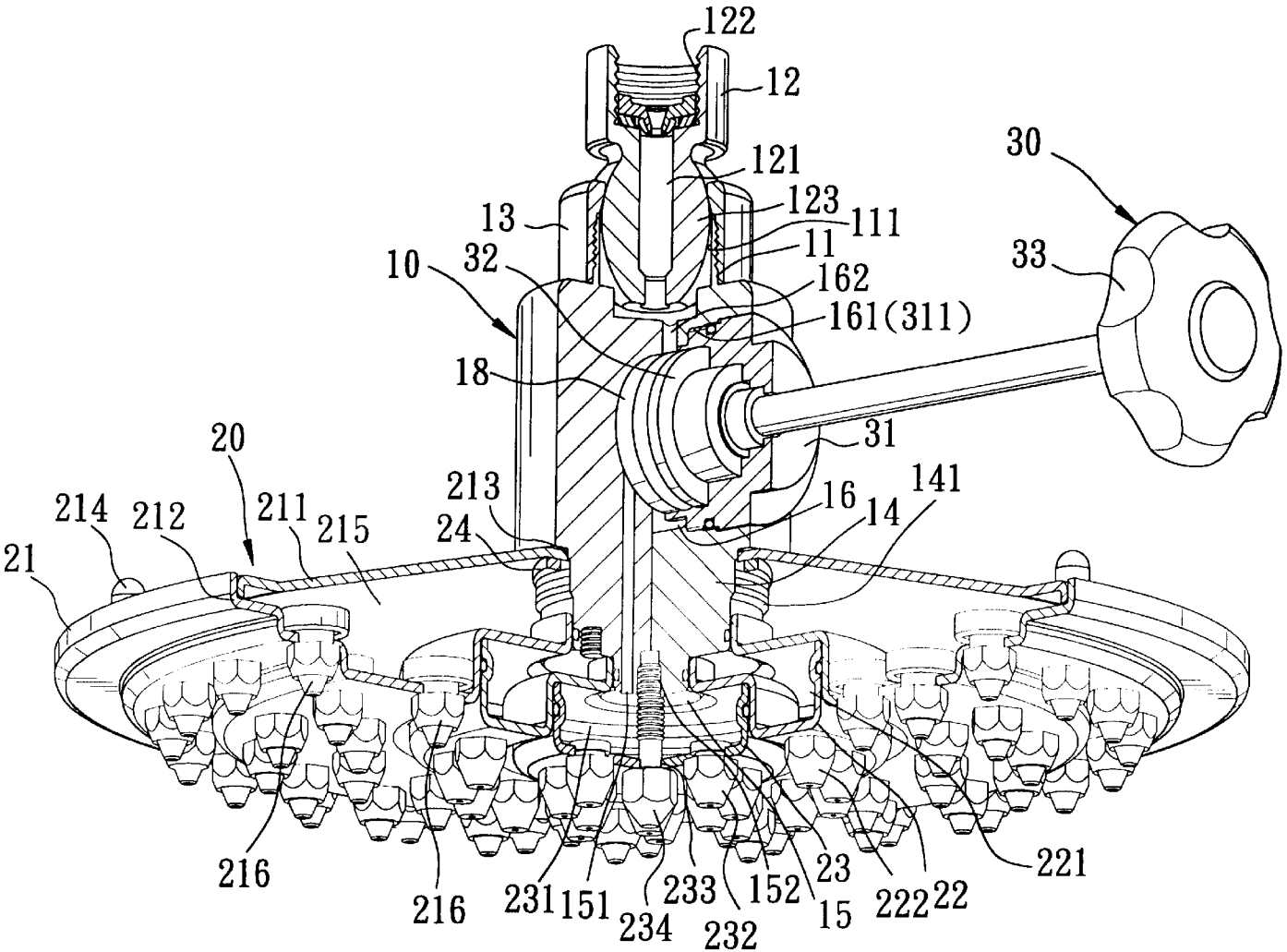
FIG. 2 is a partly sectioned, perspective view of the preferred embodiment.
Figure 3:
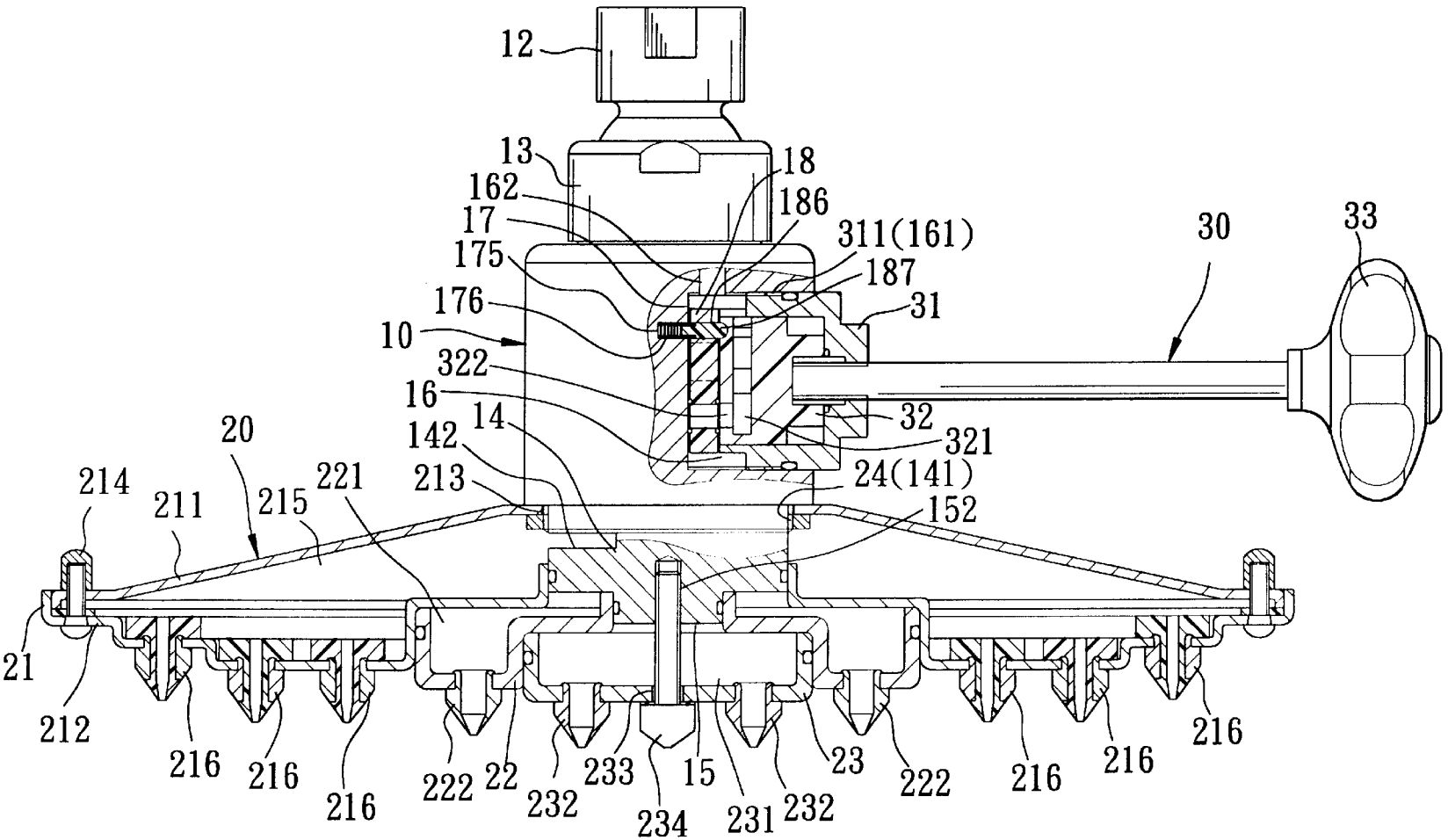
FIG. 3 is a partly sectioned, schematic view of the preferred embodiment.
Figure 4:
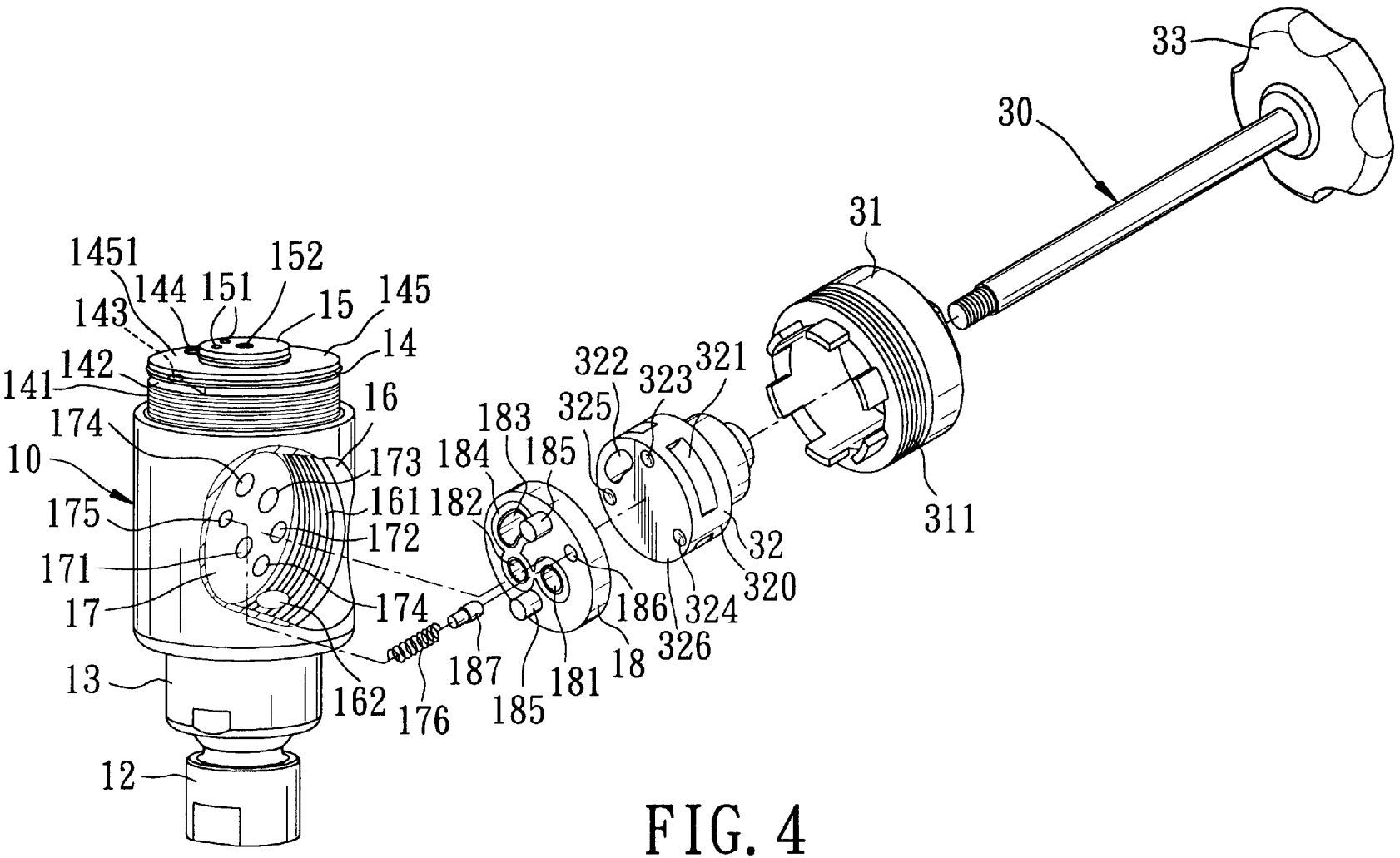
FIG. 4 is an exploded perspective view of a portion of the preferred embodiment.

With reference to FIGS. 2, 3 and 4, the housing body 10 has upper and lower ends 11,14 opposite to each other in a longitudinal direction. The upper end 11 defines a socket portion 111 therein which extends inwardly. An anchoring member 12 includes a ball portion 123 which is received in the socket portion 111 and which has a main flow duct 121 passing therethrough, and an internally threaded portion 122 to be connected to and to communicate with a water supply channel (not shown). A screw nut 13 is mounted to retain rotatably the ball portion 123 in the socket portion 111 to form a ball-socket joint.

An internally threaded inner annular wall 161 is interposed between the upper and lower ends 11,14, extends along a rotating axis which is transverse to the longitudinal direction, and terminates at an inner end surface 17 which is disposed transverse to the rotating axis so as to cooperate with the inner annular wall 161 to confine a chamber 16. The inner end surface 17 is provided with first, second and third inlet ports 173,171,172 which are communicated with the chamber 16. A main inlet 162 is formed in the inner annular wall 161 to communicate the socket portion 111 with the chamber 16, and extends radially relative to the rotating axis. Thus, when the ball portion 123 is rotated relative to the socket portion 111, the main inlet 162 is kept in fluid communication with the main flow duct 121.

In addition, the lower end 14 has an externally threaded surrounding wall 141 which extends in the longitudinal direction and which terminates at a bottom surface 145. A notch 142 is formed in the surrounding wall 141.

Figure 5:
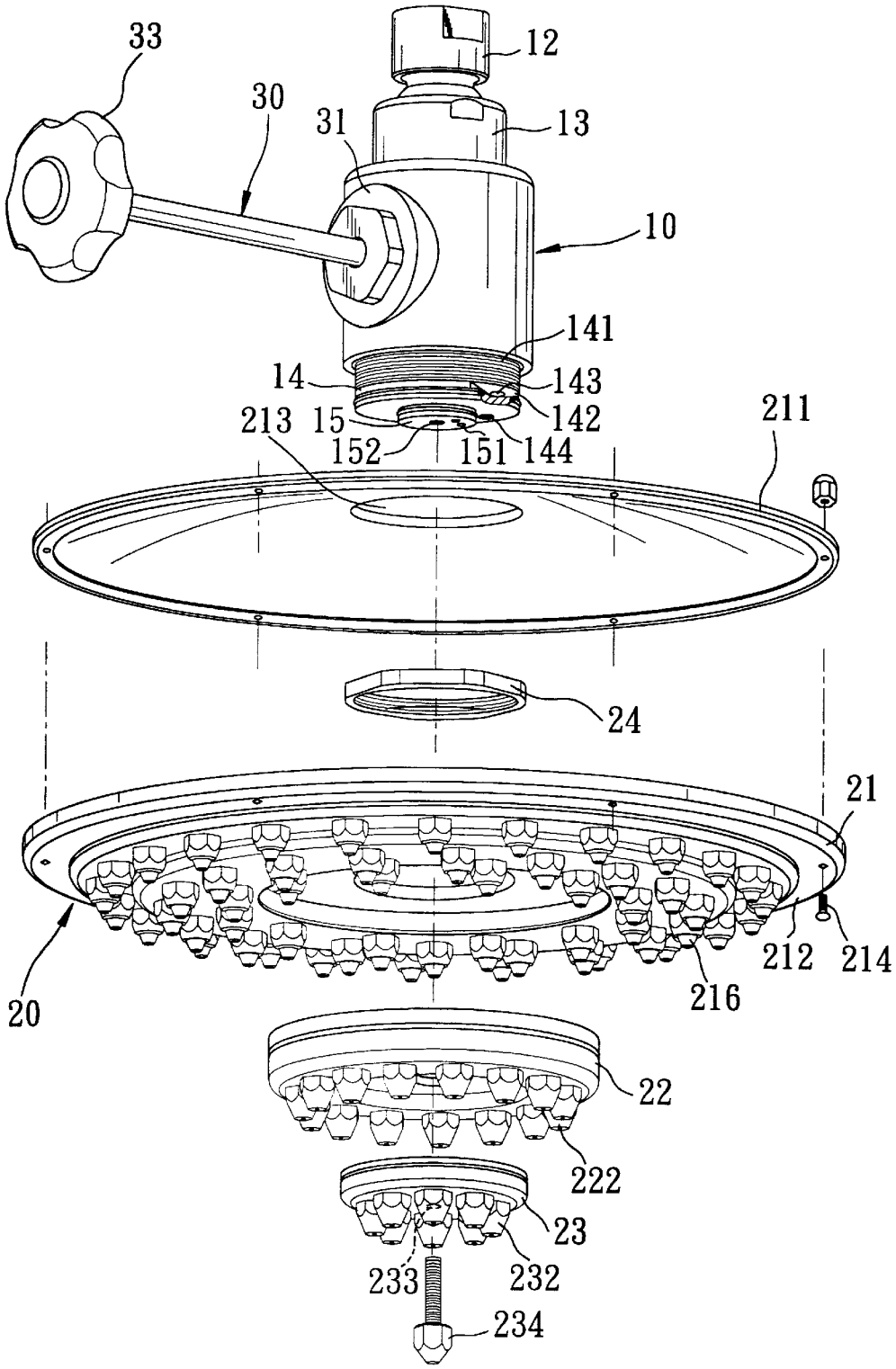
FIG. 5 is an exploded perspective view of the preferred embodiment.

With further reference to FIG. 5, the shower base 20 includes an upper wall 211 which has a central mounting hole 213 for sleeving on the surrounding wall 141 of the housing body 10 and which is secured thereon by means of a threaded engaging member 24. The shower base 20 further has a lower wall which is disposed opposite to the upper wall 211 in the longitudinal direction and which includes a central portion 23, a surrounding portion 21 that surrounds and that is spaced apart from the central portion 23, and an intermediate portions 22 that is interposed between the central and surrounding portions 23,21. The intermediate portion 22 is supported by the central portion 23 and supports the surrounding portion 21. A screw bolt 234 passes through a through hole 233 in the central portion 23, and engages threadedly a screw hole 152 in the bottom surface 145 to secure the lower wall to the lower end 14 of the housing body 10. The lower wall has a periphery 212 which is secured to a periphery of the upper wall 211 by means of screw fasteners 214 to confine a receiving space therebetween. The receiving space is divided into central, surrounding and intermediate conduits 231,215,221 which are respectively associated with the central, surrounding and intermediate portions 23,21,22. The central, surrounding and intermediate portions 23,21,22 respectively have central, surrounding and intermediate outlet ports, each of which includes a plurality of nozzle projections 232,216,222 that are provided with a plurality of jet channels therein for outward spraying of water.

Figure 7:
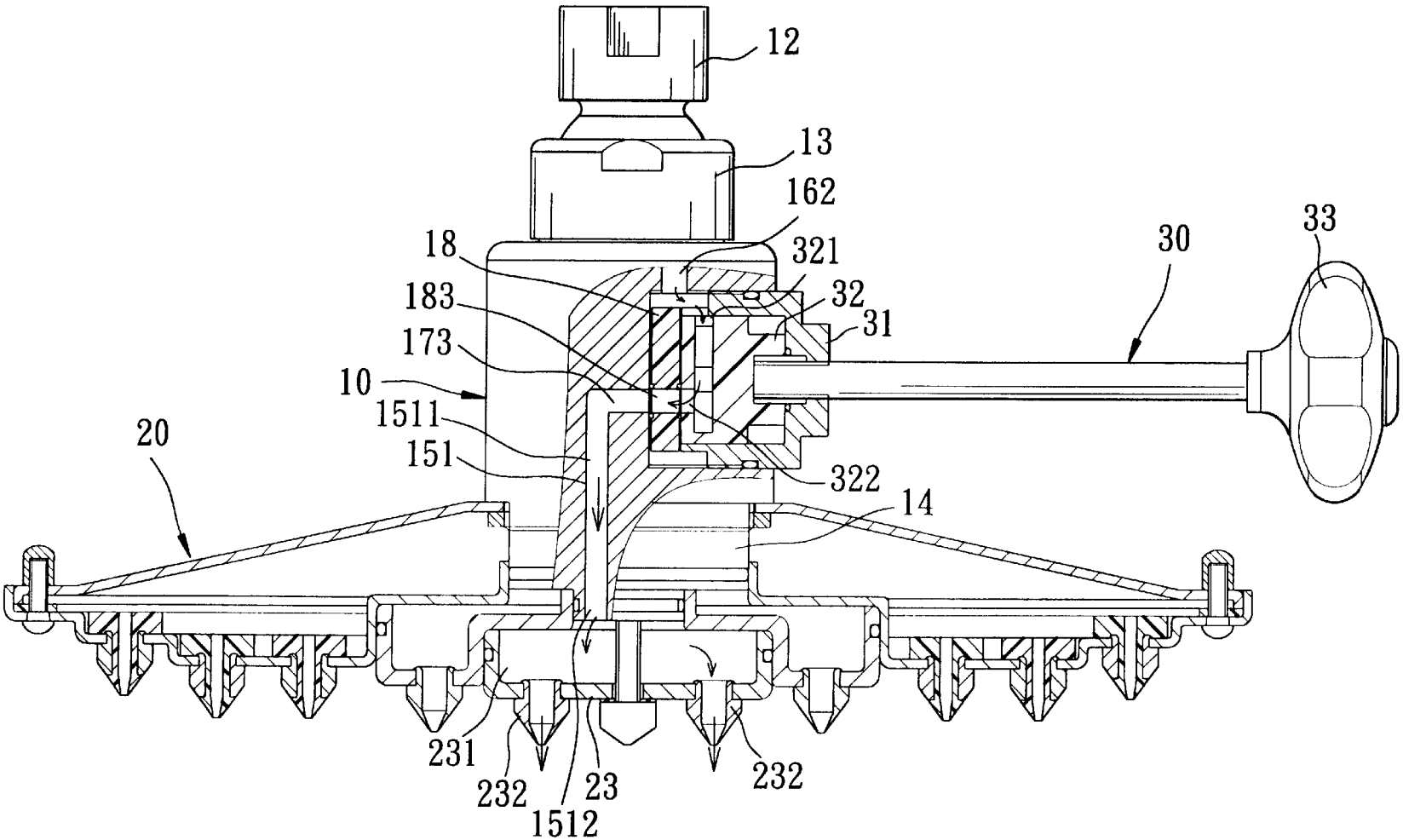
Figure 9:
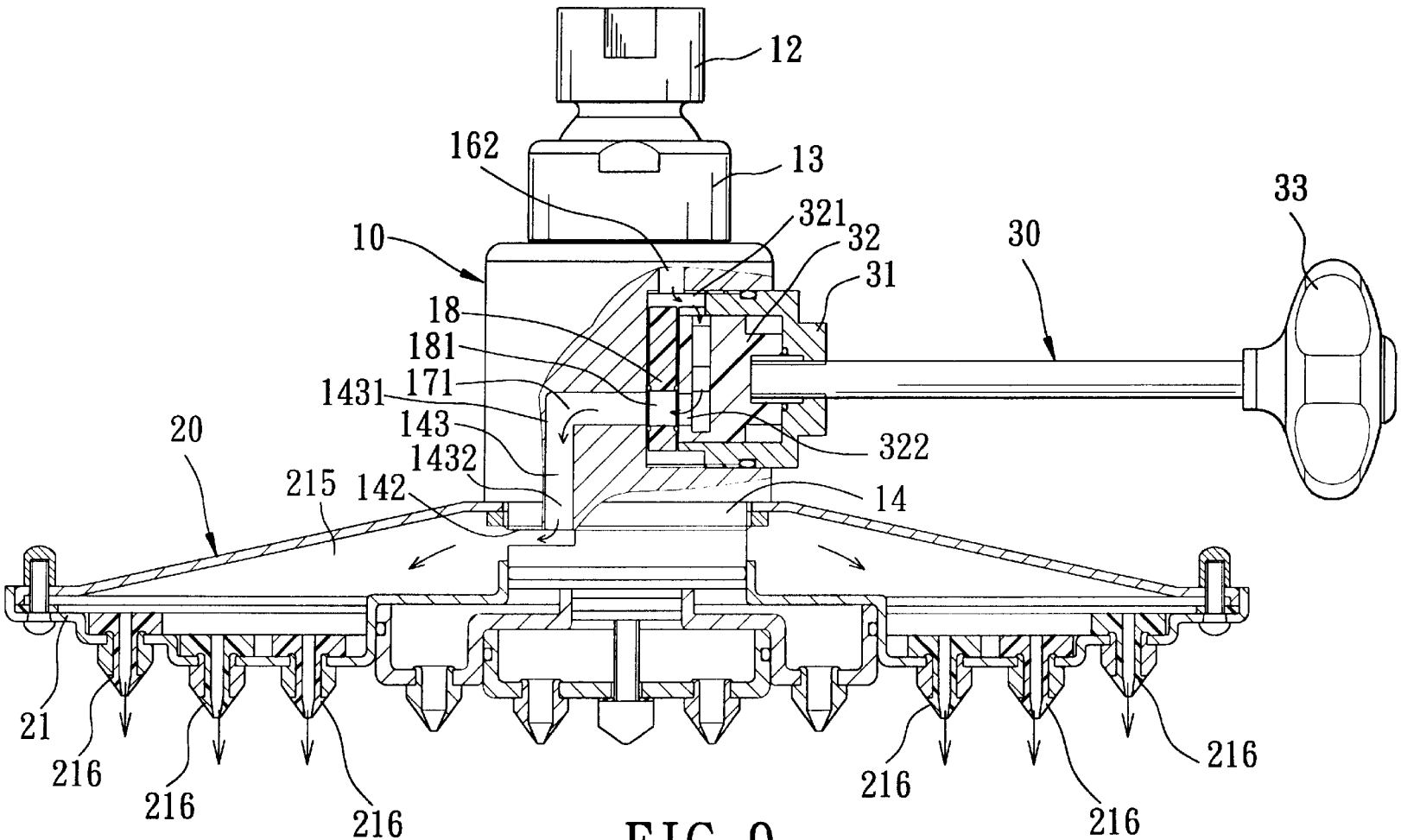
Figure 11:
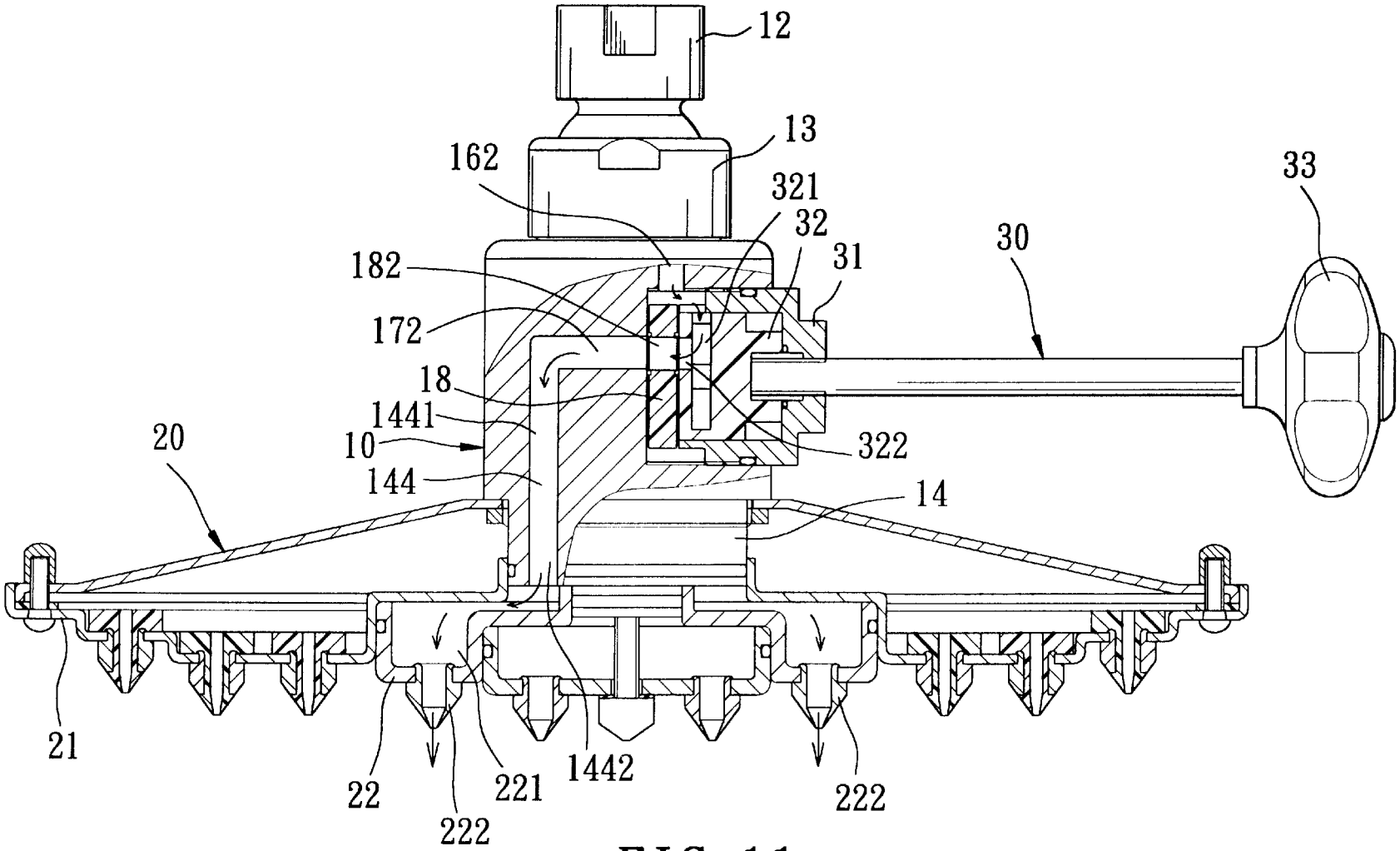

The bottom surface 145 includes a central area 15 and a surrounding area 1451 which surrounds the central area 15. First, second and third through-flow ducts 151,143,144 are formed in and through the housing body 10. With further reference to FIGS. 7, 9 and 11, the first, second and third through-flow ducts 151,143,144 respectively have first, second and third proximate ends 1511,1431,1441 which are disposed between the upper and lower ends 11,14, and which are connected to and which are communicated with the first, second and third inlet ports 173,171,172, respectively, and first, second and third distal ends 1512, 1432,1442 which respectively extend through the central area 15, the notch 142 of the surrounding wall 141, and the surrounding area 1451, and which are connected to and which are communicated with the central, surrounding and intermediate conduits 231,215,221, respectively.

Referring again to FIGS. 3 and 4, the valve and operating mechanism 30 includes a tubular seat 31, a valve member 32 and an elongated operating member 33. The tubular seat 31 has an externally threaded surrounding wall 311 which engages threadedly the inner annular wall 161 and which is received in the chamber 16. The valve member 32 is received in the tubular seat 31, and has an annular surrounding wall 320 and a valve end surface 326 which are rotatable relative to the inner annular wall 161 and the inner end surface 17 respectively about the rotating axis. The valve member 32 further has a communicating duct which has an inflow port 321 that is formed in and that extends along the annular surrounding wall 320 and that is communicated with the main inlet 162 when the annular surrounding wall 320 is rotated relative to the inner annular wall 161. The communicating duct further has an outflow port 322 which extends through the valve end surface 326 in an axial direction parallel to the rotating axis. A pad member 18 is disposed retainingly on the inner end surface 17 by two retaining posts 185 which are inserted into two insert recesses 174 in the inner end surface 17. The pad member 18 has first, second and third through holes 183,181,182 which extend therethrough in the axial direction and which are registered with the first, second and third inlet ports 173,171,172, and a sealing member 184 which is disposed thereon. The provision of the pad member 18 can ensure a watertight sliding contact between the valve end surface 326 and the inner end surface 17.

In addition, the valve end surface 326 is formed with first, second and third recesses 325,323,324 which are arranged to surround the rotating axis. A positioning pin 187 is mounted in holes 186,175 in the pad member 18 and the inner end surface 17, and is urged by a spring 176 in the axial direction to extend outwardly of the pad member 18 so as to engage one of the first, second and third recesses 325,323,324 for retention therein.

The operating member 33 has an inner connecting end which is secured on the valve member 32, and an outer operating end which extends outwardly from the inner connecting end in the axial direction and outwardly of the housing body 10 so as to be operated externally to turn the valve member 32 about the rotating axis.

Figure 6:
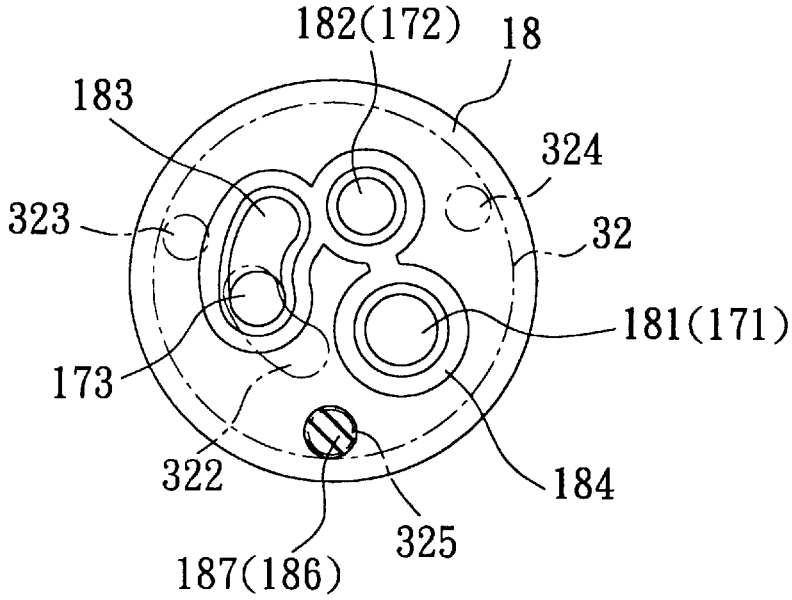
FIGS. 6 and 7 are views to illustrate a valve member of the preferred embodiment in a first position.

As illustrated, with reference to FIGS. 6 and 7, when the valve member 32 is turned about the rotating axis to a first position, the positioning pin 187 is retained in the first recess 325, and the outflow port 322 is registered with the first inlet port 173 to communicate the communicating duct with the first through-flow duct 151 so as to permit water to be discharged from the nozzle projections 232 of the central outlet port.

Figure 8:
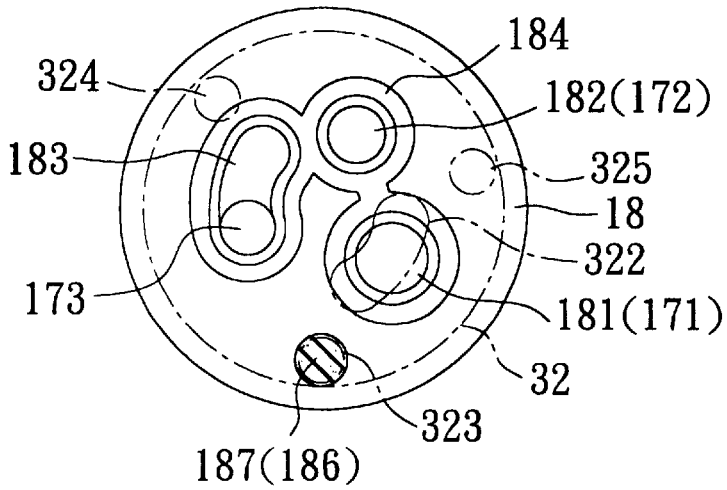
FIGS. 8 and 9 are views to illustrate the valve member in a second position.

With reference to FIGS. 8 and 9, when the valve member 32 is turned about the rotating axis to a second position, the positioning pin 187 is retained in the second recess 323, and the outflow port 322 is registered with the second inlet port 171 to communicate the communicating duct with the second through-flow duct 143 so as to permit water to be discharged from the nozzle projections 216 of the surrounding outlet port.

Figure 10:
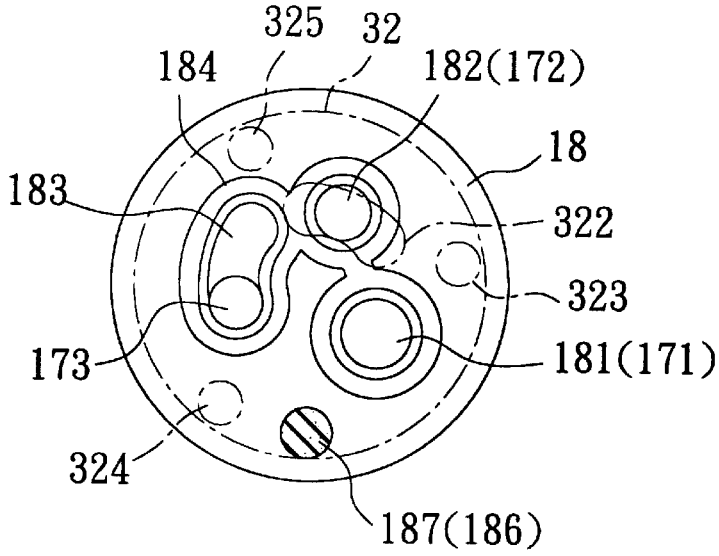
FIGS. 10 and 11 are views to illustrate the valve member in a third position.

With reference to FIGS. 10 and 11, when the valve member 32 is turned about the rotating axis to a third position, the positioning pin 187 is located between the second and third recesses 323,324, and the outflow port 322 is registered with the third inlet port 172 to communicate the communicating duct with the third through-flow duct 144 so as to permit water to be discharged from the nozzle projections 222 of the intermediate outlet port.

Figure 12:
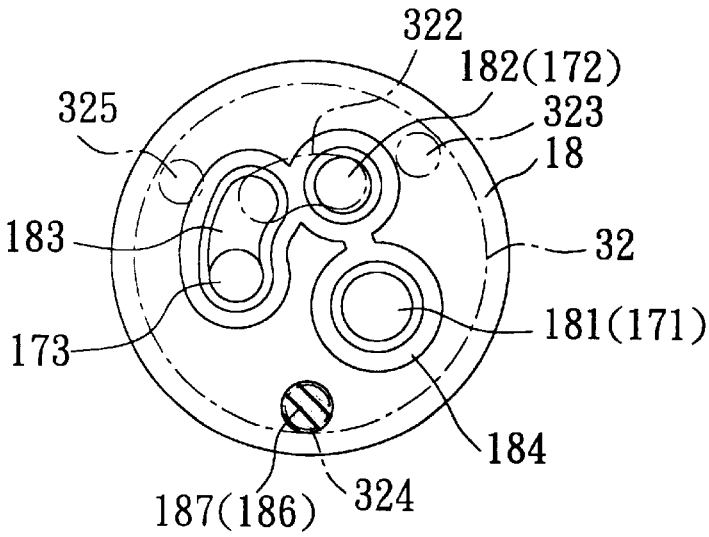
FIGS. 12 and 13 are views to illustrate the valve member in a fourth position.
Figure 13:
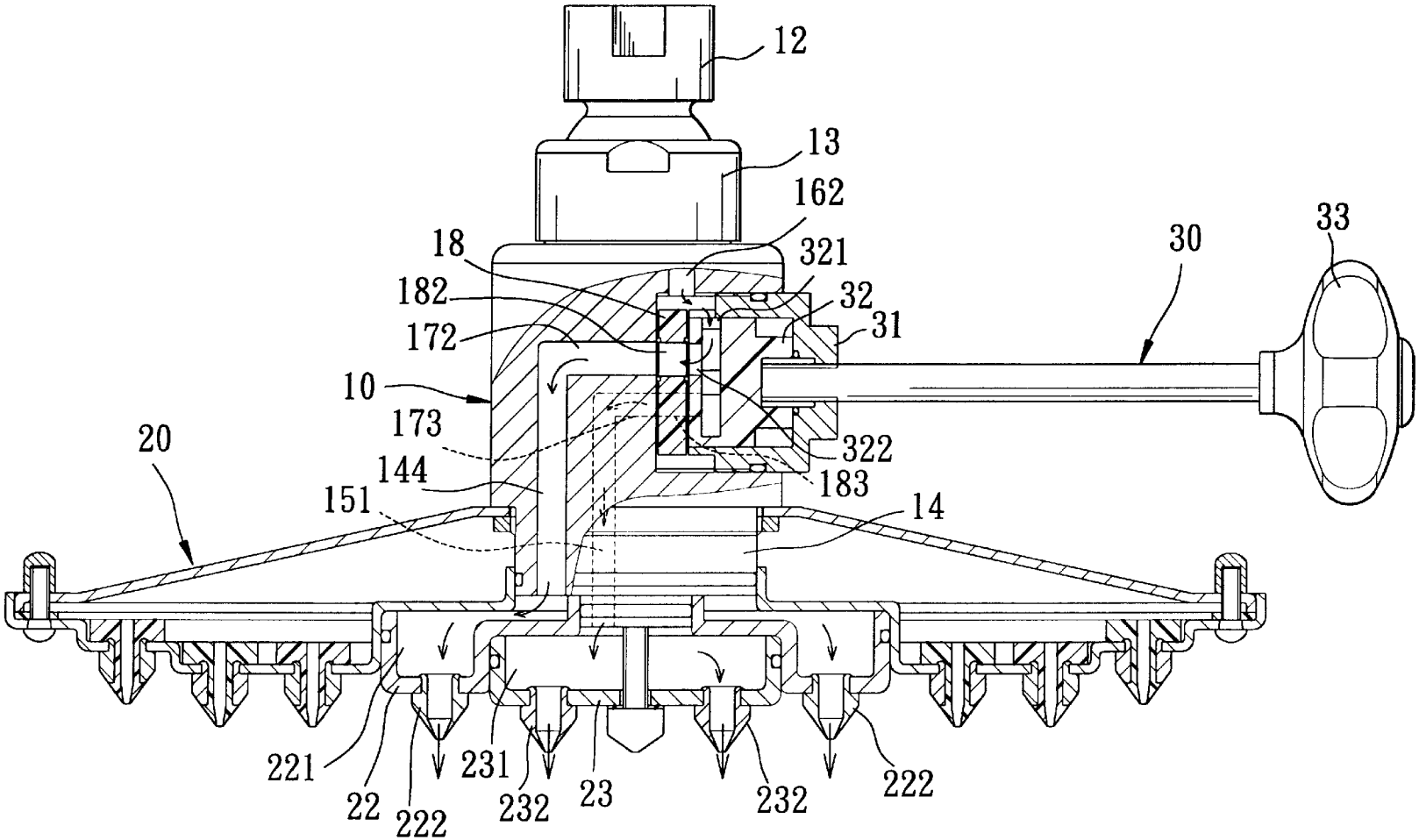

Preferably, with reference to FIGS. 12 and 13, the outflow port 322 has an elongate arcuate shape such that the valve member 32 can be turned to a fourth position, where the positioning pin 187 is retained in the third recess 324, and the outflow port 322 is registered with the first and third inlet ports 173,172 to communicate the communicating duct with the first and third through-flow ducts 151,144 so as to permit water to be discharged from the nozzle projections 232,222 of both the central and intermediate outlet ports.

Since the operating member 33 extends outwardly of the housing body 10, the user can avoid contact with the water flow from the nozzle projections 232,216,222 during the turning operation of the valve member 32, thereby preventing water from splashing and thereby resulting in convenient operation.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A shower head assembly comprising:

a housing body having upper and lower ends opposite to each other in a longitudinal direction, an inner annular wall interposed between the upper and lower ends, extending along a rotating axis which is transverse to the longitudinal direction, and terminating at an inner end surface which is disposed transverse to the rotating axis so as to cooperate with said inner annular wall to confine a chamber, said inner end surface being provided with first and second inlet ports communicated with said chamber, and a main inlet formed in said inner annular wall to communicate with said chamber, and extending radially relative to the rotating axis and toward said upper end so as to be adapted to communicate with a water supply channel;

a shower base including an upper wall anchored to said lower end, and a lower wall opposite to said upper wall in the longitudinal direction, said lower wall including a central portion, and a surrounding portion surrounding said central portion, said central and surrounding portions respectively having central and surrounding outlet ports for outward spraying of water;

first and second through-flow ducts formed in and through said housing body, said first and second through-flow ducts having first and second proximate ends which are disposed between said upper and lower ends, and which are connected to and which are communicated with said first and second inlet ports respectively, and first and second distal ends which extend into and through said upper wall so as to communicate with said central and surrounding outlet ports respectively;

a valve member received in said chamber, and having an annular surrounding wall and a valve end surface which are rotatable relative to said inner annular wall and said inner end surface respectively about the rotating axis, said valve member further having a communicating duct which has an inflow port that is formed in and that extends along said annular surrounding wall and that is communicated with said main inlet when said annular surrounding wall is rotated relative to said inner annular wall, said communicating duct further having an outflow port which extends through said valve end surface in an axial direction parallel to the rotating axis, such that when said valve member is turned about the rotating axis to a first position, said outflow port is registered with said first inlet port to communicate said communicating duct with said first through-flow duct so as to permit water to be discharged from said central outlet port, and when said valve member is turned to a second position, said outflow port is registered with said second inlet port to communicate said communicating duct with said second through-flow duct so as to permit water to be discharged from said surrounding outlet port; and an elongated operating member having an inner connecting end secured on said valve member, and an outer operating end extending outwardly from said inner connecting end in the axial direction and outwardly of said housing body so as to be operated externally to turn said valve member between the first and second positions.

2. The shower head assembly of claim 1, wherein said valve member is disposed to be turnable to a third position, and said inner end surface of said housing body is further provided with a third inlet port to be registered with said outflow port when said valve member is in the third position, said lower wall of said shower base further including an annular intermediate portion interposed between said central and surrounding portions and having an intermediate outlet port for outward spraying of water, said shower head assembly further including a third through-flow duct formed in and through said housing body and having a third proximate end which is connected to and which is communicated with said third inlet port, and a third distal end which extends into and through said upper wall so as to communicate with said intermediate outlet port, whereby in the third position, water in said communication duct is led via said third through-flow duct to flow through said upper wall so as to be discharged from said intermediate outlet port.

3. The shower head assembly of claim 2, wherein each of said central, surrounding, and intermediate outlet ports includes a plurality of nozzle projections respectively provided with a plurality of jet channels therein which are communicated with a corresponding one of said first, second and third distal ends of said first, second and third through-flow ducts.

4. The shower head assembly of claim 3, further comprising an anchoring member which includes a ball portion having a main flow duct passing therethrough to be adapted to communicate with the water supply channel, said upper end of said housing body defining a socket portion therein which extends inwardly and towards said inner annular wall so as to communicate with said main inlet, said ball portion being rotatably received in said socket portion to form a ball-socket joint such that when said ball portion is rotated relative to said socket portion, said main inlet is kept in fluid communication with said main flow duct.

5. The shower head assembly of claim 3, wherein said lower end of said housing body has a surrounding wall extending in the longitudinal direction and terminating at a bottom surface, said bottom surface including a central area through which said first distal end of said first through-flow duct passes, and a surrounding area surrounding said central area through which said third distal end of said third through-flow duct passes, said second distal end of said second through-flow duct passing through said surrounding wall of said lower end of said housing body.

6. The shower head assembly of claim 5, further comprising a threaded engaging member for securing said upper wall of said shower base to said surrounding wall of said lower end of said housing body, said lower wall of said shower base having a periphery which is secured to a periphery of said upper wall to confine a receiving space therebetween, said receiving space being divided into central, surrounding and intermediate conduits which are respectively associated with said central, surrounding and intermediate portions and which respectively communicate said central, surrounding and intermediate outlet ports with said first, second and third distal ends of said first, second and third through-flow ducts.

7. The shower head assembly of claim 3, further comprising a pad member disposed on said inner end surface, and having first, second and third through holes which extend therethrough in the axial direction and which are registered with said first, second and third inlet ports.

8. The shower head assembly of claim 7, wherein said valve end surface is formed with first, second and third recesses which are arranged to surround the rotating axis, said shower head assembly further comprising a positioning pin disposed in said pad member and urged by a biasing action in the axial direction to extend outwardly of said pad member so as to engage one of said first, second and third recesses for retention therein.

9. The shower head assembly of claim 3, wherein said outflow port is of a dimension such that when said valve member is turned to a fourth position, said outflow port is communicated with said first and third inlet ports to communicate said communicating duct with said first and third through-flow ducts and permit water to be discharged from said central and intermediate outlet ports.

* * * * *